US011433691B2

(12) United States Patent
Otsuka et al.

(10) Patent No.: US 11,433,691 B2
(45) Date of Patent: Sep. 6, 2022

(54) RECORDING APPARATUS

(71) Applicant: SEIKO EPSON CORPORATION, Tokyo (JP)

(72) Inventors: Kazuo Otsuka, Azumino (JP); Kazuhisa Takeda, Shiojiri (JP); Satoshi Kawamura, Matsumoto (JP); Haruna Takahashi, Minamiminowa-mura (JP); Keisuke Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 61 days.

(21) Appl. No.: 17/140,796

(22) Filed: Jan. 4, 2021

(65) Prior Publication Data

US 2021/0122172 A1 Apr. 29, 2021

Related U.S. Application Data

(63) Continuation of application No. 16/373,060, filed on Apr. 2, 2019, now Pat. No. 10,913,292.

(30) Foreign Application Priority Data

Apr. 5, 2018 (JP) ..... 2018-073246

(51) Int. Cl.
*B41J 11/00* (2006.01)

(52) U.S. Cl.
CPC ..... *B41J 11/007* (2013.01)

(58) Field of Classification Search
CPC ..... B41J 11/007; B41J 3/60; B41J 13/0018; B41J 13/0036; B41J 13/103; B41J 13/106;

(Continued)

(56) References Cited

U.S. PATENT DOCUMENTS 9,387,694 B2 7/2016 Tamura et al.
2013/0063531 A1 3/2013 Muraki et al.

(Continued)

FOREIGN PATENT DOCUMENTS

CN 104228356 12/2014
JP H08-217312 8/1996

(Continued)

OTHER PUBLICATIONS

IP.com search (Year: 2022).*
European Search Report issued in Application No. EP19167642 dated Oct. 29, 2019.

*Primary Examiner* — Lisa Solomon
(74) *Attorney, Agent, or Firm* — Workman Nydegger

(57) ABSTRACT

A recording apparatus includes a medium mounting section on which a medium is to be mounted, a reverse-feeding path for reversing the medium that has been fed from the medium mounting section, a recording unit configured to perform recording onto the medium that has been reversed by the reverse-feeding path, and a reverse-discharging path for reversing the medium on which recording has been performed by the recording unit and for discharge the medium to a discharge section configured to discharge the medium, in which when viewed in a medium width direction intersecting a medium transport direction, a path section for reversing the medium in the reverse-feeding path and a path section for reversing the medium in the reverse-discharging path have portions overlapping each other in the vertical direction.

20 Claims, 6 Drawing Sheets

(58) Field of Classification Search
CPC ..... B41J 13/0045; B65H 15/00; B65H 2301/333; B65H 2801/06; B65H 2801/09; B65H 2801/39
See application file for complete search history.

(56) References Cited

U.S. PATENT DOCUMENTS

| | | | |
|---|---|---|---|
| 2013/0093822 | A1 | 4/2013 | Oizumi et al. |
| 2014/0368594 | A1 | 12/2014 | Tamura et al. |
| 2015/0050045 | A1 | 2/2015 | Sato et al. |
| 2015/0274477 | A1 | 10/2015 | Kodama |
| 2017/0217221 | A1 | 8/2017 | Otsuka et al. |

FOREIGN PATENT DOCUMENTS

| | | | | |
|---|---|---|---|---|
| JP | 2003-171062 | A | | 6/2003 |
| JP | 2010-253754 | | | 11/2010 |
| JP | 2013-056502 | | | 3/2013 |
| JP | 2015-189006 | | | 11/2015 |
| JP | 2015-211415 | A | | 11/2015 |
| JP | 2015211415 | A | * | 11/2015 |
| JP | 2017-136703 | A | | 8/2017 |
| JP | 2017-213918 | | | 12/2017 |

* cited by examiner

RECORDING APPARATUS

The present application is a continuation of U.S. patent application Ser. No. 16/373,060, filed on Apr. 2, 2019, which claims priority from JP Application Serial Number 2018-073246, filed Apr. 5, 2018, the disclosures of which are hereby incorporated by reference herein in their entirety.

BACKGROUND

1. Technical Field

The present disclosure relates to a recording apparatus for performing recording onto a medium.

2. Related Art

A printer, which is an example recording apparatus, is discussed in JP-A-2003-171062. The printer discussed in JP-A-2003-171062 has a cassette for storing paper, which is an example medium, on a bottom section of the apparatus, and from the cassette, a sheet of paper is fed, reversed, and transported to a recording position above the cassette, and the recorded sheet is reversed again and discharged face-down to a tray provided at a position higher than the recording position.

In such a structure, since the cassette, a reversing path for reversing the sheet fed from the cassette, and a reversing path for reversing the recorded sheet are arranged in the vertical direction from the bottom to the top, the dimension in the apparatus height direction increases and the size of the apparatus tends to increase.

SUMMARY

The present disclosure is directed to reduce the size of a recording apparatus having path sections for reversing a medium.

According to an aspect of the present disclosure, a recording apparatus includes a medium mounting section on which a medium is to be mounted, a reverse-feeding path for reversing the medium that has been fed from the medium mounting section, a recording unit configured to perform recording onto the medium that has been reversed by the reverse-feeding path, and a reverse-discharging path for reversing the medium on which recording has been performed by the recording unit and for guiding the medium to a discharge section configured to discharge the medium, in which when viewed in a medium width direction intersecting a medium transport direction, a path section for reversing the medium in the reverse-feeding path and a path section for reversing the medium in the reverse-discharging path have portions overlapping each other in the vertical direction.

In this aspect of the present disclosure, when viewed in a medium width direction intersecting a medium transport direction, a path section for reversing the medium in the reverse-feeding path and a path section for reversing the medium in the reverse-discharging path have portions overlapping each other in the vertical direction. Accordingly, with the structure having the reverse-feeding path and the reverse-discharging path, the vertical dimension of the apparatus can be reduced and the increase in size of the apparatus can be prevented.

In the recording apparatus according the present disclosure, the reverse-feeding path may reverse the medium by an outer circumferential surface of a reversing roller. In the recording apparatus according the present disclosure, with the structure in which the reverse-feeding path reverses the medium by an outer circumferential surface of a reversing roller, the functional effect according to the above-described aspect can be achieved.

The recording apparatus according to the present disclosure may include a guiding path for guiding the medium that is transported in a direction opposite to the transport direction in recording from a position facing the recording unit to the reverse-feeding path.

In the recording apparatus according to the present disclosure, a guiding path for guiding the medium that is transported in a direction opposite to the transport direction in recording from a position facing the recording unit to the reverse-feeding path is included, and thus two-sided printing can be made to the medium by sending the medium from the guiding path to the reverse-feeding path. Since the medium is reversed for two-sided printing by using the reverse-feeding path, it is not necessary to provide a dedicated path for reversing a medium for two-sided recording, and thus the increase in size of the apparatus can be prevented.

According to another aspect of the present disclosure, a recording apparatus includes an inclined supporting section configured to support a medium in an inclined orientation, a feeding roller configured to feed the medium from the inclined supporting section, a recording unit configured to perform recording onto the medium fed from the inclined supporting section, and a reverse-discharging path for reversing the medium on which recording has been performed by the recording unit and guiding the medium to a discharge section configured to discharge the medium, in which when viewed in a medium width direction intersecting a medium transport direction, the feeding roller and a path section for reversing the medium in the reverse-discharging path have portions overlapping each other in the vertical direction.

In the recording apparatus according to the present disclosure, when viewed in a medium width direction intersecting a medium transport direction, the feeding roller and a path section for reversing the medium in the reverse-discharging path have portions overlapping each other in the vertical direction. Accordingly, with the structure having the feeding roller and the reverse-discharging path, the vertical dimension of the apparatus can be reduced and the increase in size of the apparatus can be prevented.

The recording apparatus according to the present disclosure may include a carriage provided with the recording unit, the carriage being configured to move along a medium width axis, in which when viewed in the medium width direction, the carriage and a path section for reversing the medium in the reverse-discharging path have portions overlapping each other in the vertical direction.

In the structure in which, when viewed in the medium width direction, the carriage and a path section for reversing the medium in the reverse-discharging path have portions overlapping each other in the vertical direction, some of the above-described functional effects can be achieved.

According to still another aspect of the present disclosure, a recording includes a medium mounting section on which a medium is to be mounted, a recording unit configured to discharge a liquid for recording onto the medium fed from the medium mounting section, a carriage provided with the recording unit, the carriage being configured to move along a medium width axis intersecting a medium transport direction, a liquid container configured to store a liquid to be discharged from the recording unit, a liquid tube configured to introduce the liquid from the liquid container to the recording unit, and a reverse-discharging path for reversing the medium on which recording has been performed by the recording unit and guiding the medium to a discharge section configured to discharge the medium, in which the liquid tube extends along the reciprocation axis of the carriage, and has a folded portion that is folded from one reciprocation direction to the other reciprocation direction, and when viewed in the medium width direction, the folded portion of the liquid tube and the reverse-discharging path have portions overlapping each other in the vertical direction.

In the recording apparatus according to the present disclosure, when viewed in the medium width direction, the folded portion of the liquid tube and the reverse-discharging path have portions overlapping each other in the vertical direction. Accordingly, in the structure having the folded portion of the liquid tube and the reverse-discharging path, the vertical dimension of the apparatus can be reduced and the increase in size of the apparatus can be prevented.

The recording apparatus according to the present disclosure may include a medium receiving tray configured to receive the medium discharged from the discharge section, in which when viewed in the medium width direction, the medium receiving tray and a path section for reversing the medium in the reverse-discharging path have portions overlapping each other in the vertical direction.

In the structure in which, when viewed in the medium width direction, the medium receiving tray and a path section for reversing the medium in the reverse-discharging path have portions overlapping each other in the vertical direction, some of the above-described functional effects can be achieved.

In the recording apparatus according to the present disclosure, when the medium transport direction in recording by the recording unit is an apparatus front side and a direction opposite to the medium transport direction is an apparatus rear side, the reverse-feeding path may be on the apparatus rear side and the reverse-discharging path may be on the apparatus front side.

In this structure, since the reverse-feeding path is on the apparatus rear side and the reverse-discharging path is on the apparatus front side, when viewed in the medium width direction, the amount of overlap among the reverse-feeding path and the reverse-discharging path in the vertical direction can be readily ensured.

In the recording apparatus according to the present disclosure, a lower end portion of the reversing roller, a range in which recording is performed onto the medium by the recording unit, and a range in the reverse-discharging path where upward bending of the medium starts may be aligned along a horizontal direction.

In this structure, since a lower end portion of the reversing roller that is in the reverse-feeding path, a range in which recording is performed onto the medium by the recording unit, and a range in the reverse-discharging path where upward bending of the medium starts are aligned along a horizontal direction, when viewed in the medium width direction, the amount of overlap among the reverse-feeding path, the recording unit, and the reverse-discharging path in the vertical direction can be sufficiently ensured, and further reduction in size of the apparatus can be achieved.

The recording apparatus according to the present disclosure may include an inclined supporting section configured to support the medium in an inclined orientation, a feeding roller configured to feed the medium from the inclined supporting section, and a carriage provided with the recording unit, the carriage being configured to move along the medium width axis, in which when the medium transport direction in recording by the recording unit is an apparatus front side and a direction opposite to the medium transport direction is an apparatus rear side, from the apparatus rear side toward the apparatus front side, the reversing roller, the feeding roller, the carriage, and the reverse-discharging path are disposed in this order, and when viewed in the medium width direction, the reversing roller, the feeding roller, the carriage, and the path section for reversing the medium in the reverse-discharging path have portions overlapping each other in the vertical direction.

In the recording apparatus according to the present disclosure, when viewed in the medium width direction, the reversing roller, the feeding roller, the carriage, and the path section for reversing the medium in the reverse-discharging path have portions overlapping each other in the vertical direction. Accordingly, the vertical dimension of the apparatus can be reduced and the increase in size of the apparatus can be prevented.

The recording apparatus according to the present disclosure may include a circuit board provided with electronic components, in which when viewed in the medium width direction, the circuit board and the path section for reversing the medium in the reverse-discharging path have portions overlapping each other in the vertical direction.

In the recording apparatus according to the present disclosure, when viewed in the medium width direction, the circuit board and the path section for reversing the medium in the reverse-discharging path have portions overlapping each other in the vertical direction. Accordingly, the vertical dimension of the apparatus can be reduced and the increase in size of the apparatus can be prevented.

The recording apparatus according to the present disclosure may include a power supply unit configured to supply electric power, in which when viewed in the medium width direction, the power supply unit and the path section for reversing the medium in the reverse-discharging path have portions overlapping each other in the vertical direction.

In the recording apparatus according to the present disclosure, when viewed in the medium width direction, the power supply unit and the path section for reversing the medium in the reverse-discharging path have portions overlapping each other in the vertical direction. Accordingly, the vertical dimension of the apparatus can be reduced and the increase in size of the apparatus can be prevented.

DESCRIPTION OF EXEMPLARY EMBODIMENTS

Figure 1:
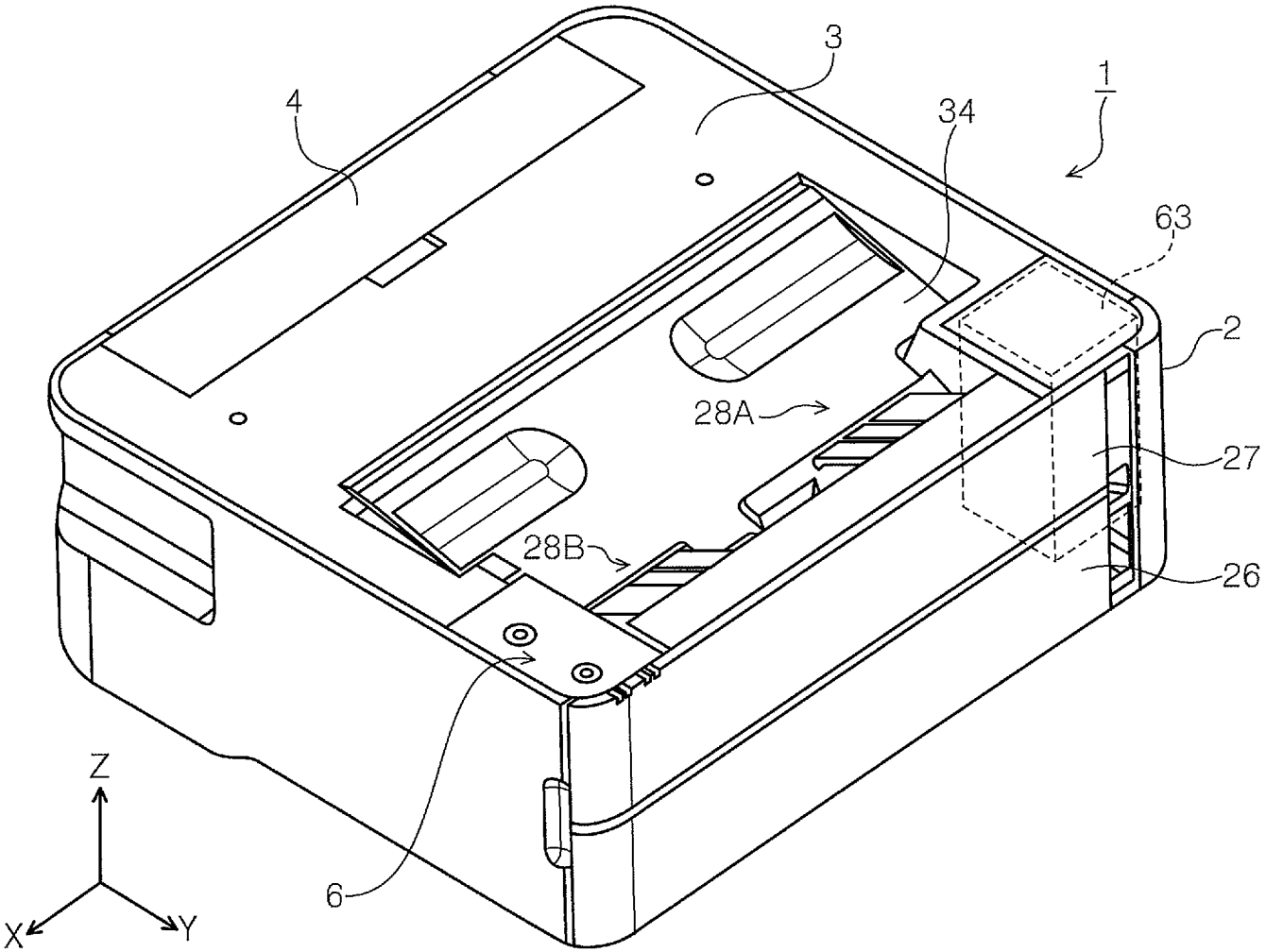
FIG. 1 is an external perspective view of a printer according to an embodiment of the disclosure.

Hereinafter, a recording apparatus according to an embodiment of the disclosure will be described with reference to the drawings. In the following description, an ink jet printer 1 (hereinafter, simply referred to as a "printer 1") will be described as an example recording apparatus according to the embodiment of the disclosure. The method of performing recording onto a sheet of paper, which is an example medium, is not limited to the ink jet system, and various systems such as an electrophotographic system or a dot impact system may be employed, and embodiments of the disclosure can be applied to any of the systems. The ink jet systems include various systems such as a system in which an ink cartridge is mounted on a carriage having a recording head, a system that has an ink accommodating section provided outside a carriage and the ink accommodating section and the carriage are connected by an ink tube, and the like. Embodiments of the disclosure can be applied to any of the systems. The printer 1 according to the embodiment has an ink accommodating section that is provided outside a carriage and the ink accommodating section and the carriage are connected by an ink tube. More specifically, the ink jet systems include a system in which a recording head is mounted on a carriage and the carriage is moved along an axis that intersects a sheet transport direction and a system having a fixed recording head that is large enough to cover the whole area along an axis that intersects a sheet transport direction. Embodiments of the disclosure can be applied to any of the systems. The printer 1 according to the embodiment has a movable carriage.

In an X-Y-Z coordinate system in the drawings, an X-axis direction denotes an apparatus width direction and a sheet width direction, a Y-axis direction denotes a sheet transport direction in recording onto a sheet and an apparatus depth direction, and a Z-axis direction denotes an apparatus height direction and a gravity direction. A direction toward which a sheet is transported is referred to as "downstream" and the opposite direction is referred to as "upstream". A +Y direction denotes an "apparatus front side", and a −Y direction side denotes an "apparatus rear side".

Figure 2:
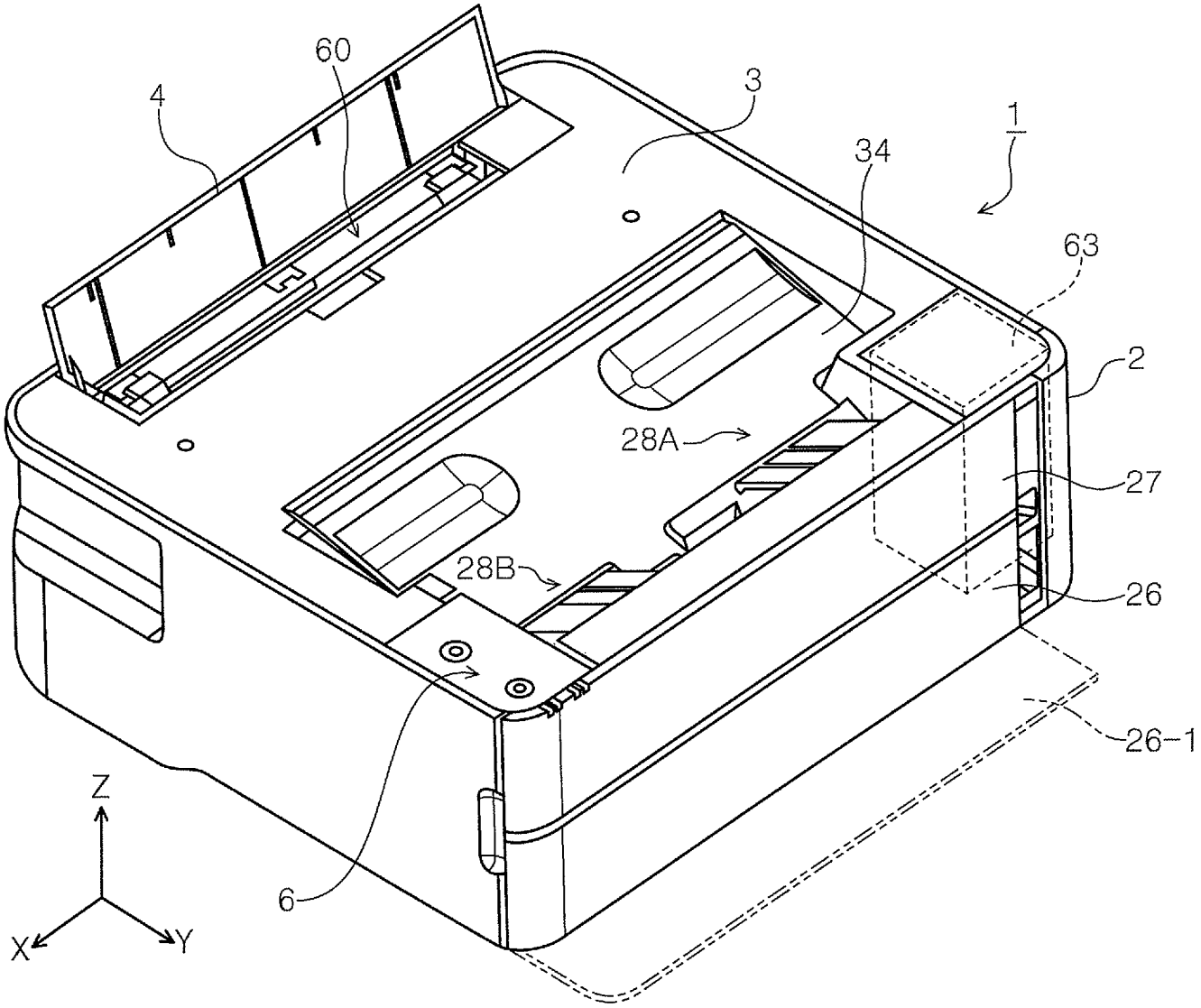
FIG. 2 is an external perspective view of a printer according to an embodiment of the disclosure.

As illustrated in FIG. 1 and FIG. 2, the printer 1 has an apparatus body 2. An operation section 6 that has a plurality of operation buttons is provided on an upper surface of the apparatus body 2. To the upper surface of the apparatus body 2, an openable and closable cover 4 is provided. The cover 4 is opened as illustrated in FIG. 2 to expose a paper feed port 60. The upper surface of the apparatus body 2 includes a top panel member 3.

On the front side of the apparatus body 2, a first cover 26 and a second cover 27 are provided. The user can open the second cover 27 to perform an operation for solving a jam occurred in a face-down discharge path (reverse-discharging path R3), which will be described below. The first cover 26 is opened and a path-switching flap 25 (see FIG. 3 and FIG. 4) is lowered to perform face-up discharging, which will be described below. In FIG. 2, a reference numeral 26-1 denotes the first cover 26 that is opened.

Figure 3:
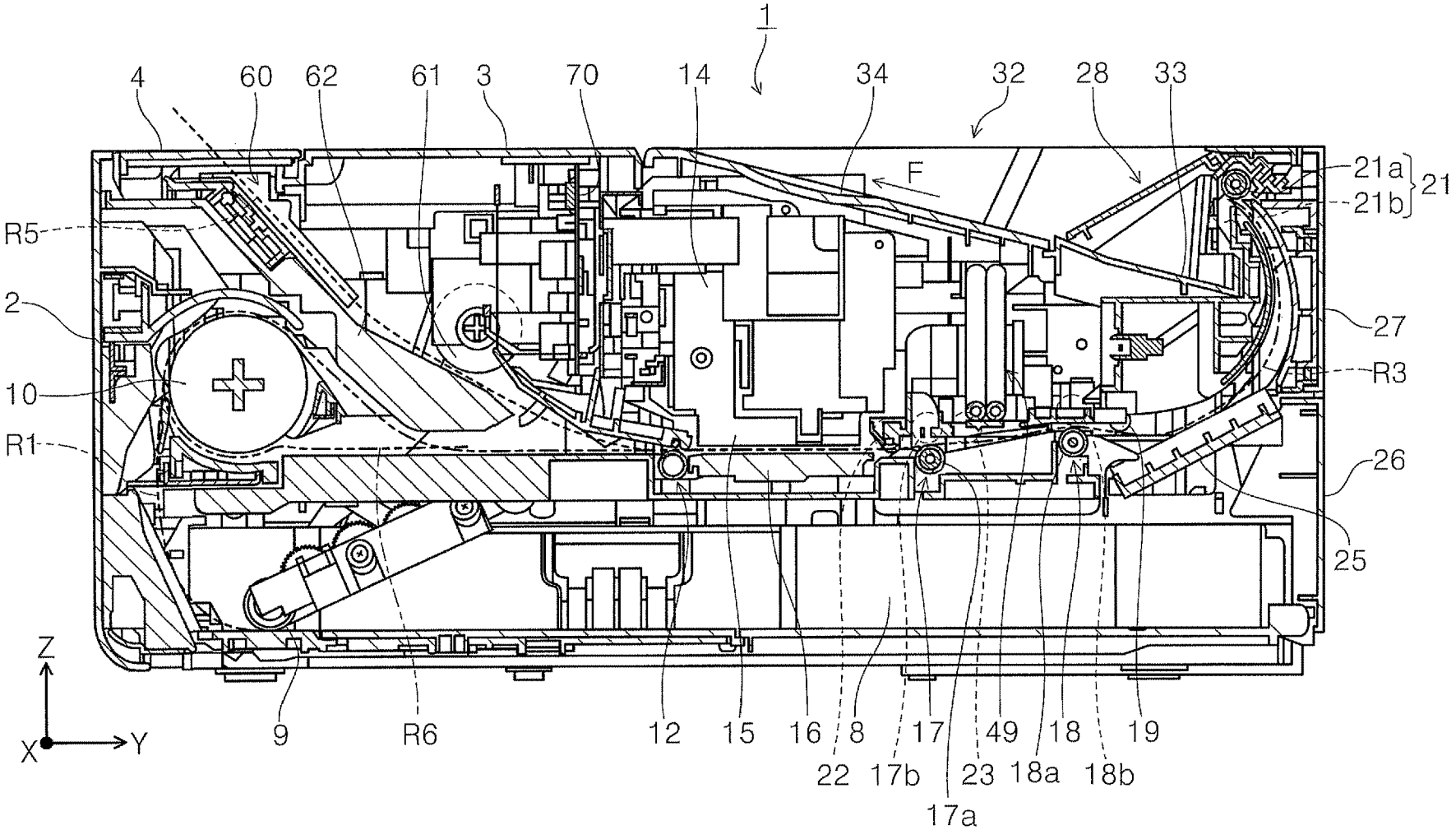
FIG. 3 is a side cross-sectional view illustrating a sheet transport path of a printer according to an embodiment of the disclosure.
Figure 4:
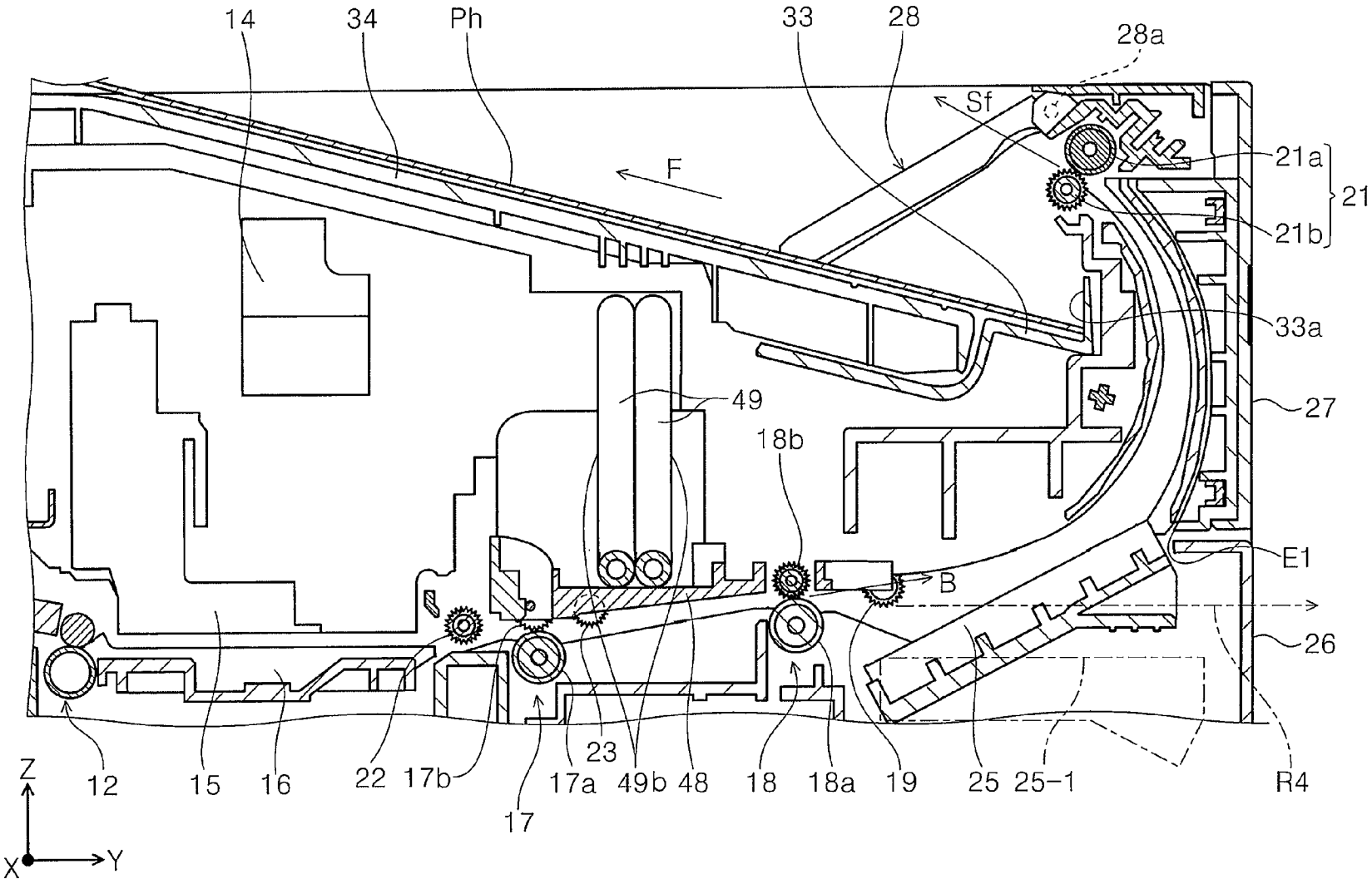
FIG. 4 is a partial enlarged view of FIG. 3.
Figure 5:
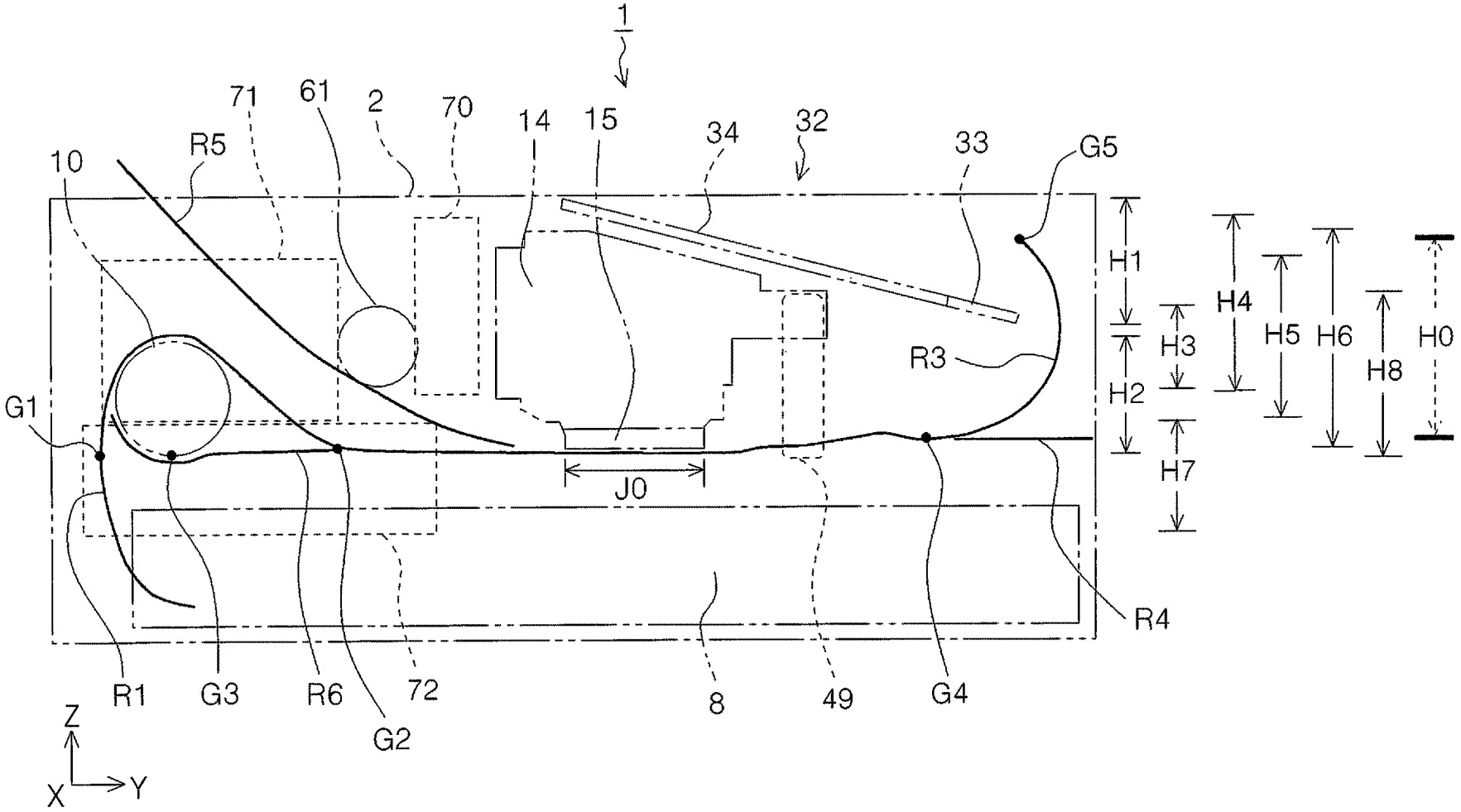
FIG. 5 schematically illustrates an arrangement of components of a printer as viewed in a sheet width direction.

With reference to FIGS. 3 to 5, paths on which a sheet passes through in the printer 1 will be described. In FIG. 3, a reverse-feeding path R1 is defined as, for example, a path from a sheet storage section 8 to a feeding roller pair 12. The reverse-discharging path R3 for face-down discharging is defined as, for example, a path from a downstream roller pair 18 to a discharge roller pair 21. A straight discharge path R4 for face-up discharge (FIG. 4) is defined as, for example, a path that extends in a substantially horizontal direction from the downstream roller pair 18 to the first cover 26 that is closed. A rear-feeding path R5 is defined as, for example, a path along which a sheet that is inserted from the paper feed port 60 on the apparatus rear side passes via a feeding roller 61 to the feeding roller pair 12. A switchback transport path R6 is used to reversely feed a recorded sheet to the reverse-feeding path R1.

The reverse-feeding path R1 and the reverse-discharging path R3 include path sections for reversing a sheet respectively. In FIG. 5, which schematically illustrates FIG. 2, the path section for reversing a sheet in the reverse-feeding path R1 is, in this embodiment, from a position G1 to position G2. The position G1 is at the same position in the height direction as a position G3 of a lower end portion of a reversing roller 10. The position G2 is a position where the reverse-feeding path R1 and the switchback transport path R6 intersect. The path section for reversing a sheet in the reverse-discharging path R3 is, in this embodiment, from a position G4 to a position G5. The position G4 is a position of a regulating roller 19 described below, and the position G5 is a position of a discharge roller pair 21 described below. The "path section for reversing a sheet" is a path section for largely changing the traveling direction of a sheet to reverse the sheet.

Hereinafter, the structure along the sheet transport paths in the printer 1 will be described in detail. In FIG. 3, the sheet storage section 8 that can store a plurality of sheets is disposed in a bottom section of the apparatus body 2. The sheets that are stored in the sheet storage section 8 are fed downstream by a pickup roller 9 that is driven by a motor (not illustrated). On the downstream side of the pickup roller 9, a reversing roller 10 that is driven by a motor (not illustrated) is disposed. The sheet fed from the sheet storage section 8 is bent and reversed by the reversing roller 10 and is sent toward the downstream feeding roller pair 12 that is driven by a motor (not illustrated). Specifically, the reverse-feeding path R1 reverses a sheet by an outer circumferential surface of the reversing roller 10. On the apparatus rear side, an inclined supporting section 62 is provided to support a sheet that is inserted from the paper feed port 60 provided on the apparatus upper side in an inclined orientation. The sheet that is supported by the inclined supporting section 62 is sent toward the feeding roller pair 12 by the feeding roller 61 that is driven by a motor (not illustrated).

On the downstream side of the feeding roller pair 12, a sheet supporting section 16 and a recording head 15 are disposed to face each other. The sheet supporting section 16 supports a sheet. The recording head 15 serves as a recording unit for discharging an ink, which is an example liquid, onto a sheet to perform recording. The recording head 15 is provided on a carriage 14, and the carriage 14 is driven to reciprocate along the sheet width axis by a motor (not illustrated). On the front right side of the printer 1, an ink tank 63 (FIG. 1 and FIG. 2) that serves as a liquid container is provided. From the ink tank 63, an ink flows through an ink tube 49 that serves as a liquid tube. The ink tube 49 extends along the reciprocation axis (X direction) of the carriage 14, and has a folded portion 49*b* that is folded from one reciprocation direction to the other reciprocation direction.

An upstream roller pair 17 is disposed downstream of the recording head 15. The upstream roller pair 17 includes a driving roller 17*a* (FIG. 4) that is driven by a motor (not illustrated) and a driven roller 17*b* (FIG. 4) that rotates to follow the driving roller 17*a*. A downstream roller pair 18 is disposed downstream of the upstream roller pair 17. The downstream roller pair 18 includes a driving roller 18*a* (FIG. 4) that is driven by a motor (not illustrated) and a driven roller 18*b* (FIG. 4) that rotates to follow the driving roller 18*a*. A recorded sheet is fed downstream by the upstream roller pair 17 and the downstream roller pair 18.

A driven roller 22 for reducing sheet deformation is disposed upstream of the upstream roller pair 17. Between the upstream roller pair 17 and the downstream roller pair 18, a driven roller 23 for regulating the sheet traveling direction is disposed. Specifically, the driven roller 23 has the following functions. In FIG. 4, if the direction in which a sheet is fed by the driven roller 22 and the upstream roller pair 17 becomes upward, the leading edge of the sheet will travel along a roller supporting member 48 and strike against the driven roller 18*b*, and this can cause decrease in the transport precision. The driven roller 23 adjusts the sheet traveling direction so as not to become upward to reduce striking of the leading edge of the sheet against the driven roller 18*b* and reduce the decrease in the transport precision.

To perform two-sided printing, the upstream roller pair 17 and the downstream roller pair 18 are reversely rotated to transport a sheet in a direction (left direction in FIG. 3) opposite to the transport direction (right direction in FIG. 3) in recording. By the transport, the sheet on which recording has been made on a first side (front side) is transported via the switchback transport path R6 (guiding path) to the reverse-feeding path R1. Then, recording is performed onto a second side (back side). As described above, since the sheet is reversed for two-sided printing by using the reverse-feeding path R1, it is not necessary to provide a dedicated path for reversing a sheet for two-sided recording, and thus the increase in size of the apparatus can be reduced.

On the downstream side of the downstream roller pair 18, a path-switching flap 25 is disposed. The path-switching flap 25 can swing about a pivot shaft (not illustrated). The printer 1 can select the two paths as the reverse-discharging path as described above. One of the paths is the reverse-discharging path R3 for face-down discharge for discharging a recorded sheet with the surface placed face down onto which recording has been made most recently, and the other one is the straight discharge path R4 for face-up discharge (FIG. 4) for discharging a recorded sheet with the surface placed face up onto which recording has been made most recently.

When the reverse-discharging path R3 for face-down discharge is used, the path-switching flap 25 is held in an orientation (inclined orientation) indicated by solid lines in FIG. 3 and FIG. 4. When the straight discharge path R4 for face-up discharge is used, the path-switching flap 25 is held in an orientation (horizontal orientation) indicated by a virtual line 25-1 in FIG. 4.

A regulating roller 19 regulates the direction in which a sheet travels. Specifically, in order to reduce a sheet lift in the sheet supporting section 16, the upstream roller pair 17 and the downstream roller pair 18 are disposed such that axial centers of the driven rollers are disposed upstream of axial centers of the driving rollers respectively. With this structure, the sheet feeding direction by the upstream roller pair 17 and the downstream roller pair 18 becomes slightly upward (arrow B in FIG. 4) with respect to the horizontal direction. When the straight discharge path R4 for face-up discharge is used, if the sheet feeding direction by the downstream roller pair 18 becomes upward as indicated by the arrow B, in some cases, the leading edge of the sheet is caught by an opening edge portion (indicated by a reference numeral μl) and is not properly discharged. The regulating roller 19 adjusts downward the sheet traveling direction to avoid such a problem. The regulating roller 19 is supported by the roller supporting member 48. The roller supporting member 48 also supports the ink tube 49. The ink tube 49 is regulated between the roller supporting member 48 and a back side of a first discharge tray 34 so as not to be deformed.

At an end position of the reverse-discharging path R3 for bending and reversing a sheet, a discharge roller pair 21 that is included in a "discharge section" is disposed. The discharge roller pair 21 includes a discharge driving roller 21*a* that is driven by a motor (not illustrated) and a discharge driven roller 21*b* that rotates to follow the discharge driving roller 21*a* as illustrated in FIG. 4. A sheet discharged by the discharge roller pair 21 from the reverse-discharging path R3 is supported by a sheet receiving section 32 that serves as a medium receiving tray. An upper surface of the sheet receiving section 32 is used as a medium receiving surface for receiving a discharged sheet. The sheet receiving section 32 according to the embodiment includes, from the upstream side to the downstream side, a tray base section 33, the first discharge tray 34, and the top panel member 3. Upper surfaces of the tray base section 33, the first discharge tray 34, and the top panel member 3 constitute the medium receiving surface. FIG. 4 illustrates an example sheet Ph that is being supported. A direction indicated by an arrow F is a direction in which a sheet discharged onto the sheet receiving section 32 travels. The cover 4 that is opened as in FIG. 2 serves as a stopper for preventing a sheet discharged face-down via the reverse-discharging path R3 from being discharged beyond the printer 1.

The sheet discharged face-down is pressed by a pressure flap group 28 that is disposed upstream of the sheet receiving section 32. More specifically, the pressure flap group 28 is rotatable about a rotation shaft 28*a* (FIG. 4) and falls by its own weight. The pressure flap group 28 presses a discharged sheet from above to form a crest portion in the sheet along the sheet discharging direction, increasing the stiffness of the sheet in the sheet discharging direction. The pressure flap group 28 reduces curing of a sheet discharged face-down on the sheet receiving section 32, particularly, reduces curing of the sheet with its upper surface facing inward. More specifically, a trailing edge (upstream end) of a curling discharged sheet blocks the sheet discharge port and may cause the next sheet to be discharged under the already-discharged sheet or the next sheet may push out the already-discharged sheet, resulting in poor paper alignment on the sheet receiving section 32.

The pressure flap group 28 presses the trailing edge (upstream end) of a sheet to reduce the above-mentioned problem and forms a crest in the sheet along the sheet discharging direction F, increasing the sheet stiffness in the sheet discharging direction F and reducing curling to the leading edge (downstream end) of the sheet. This curling reducing effect is exerted until the trailing edge (upstream end) of the sheet passes through the discharge roller pair 21. The pressure flap group 28 includes a right pressure flap group 28A and a left pressure flap group 28B as illustrated in FIG. 1 and FIG. 2.

The sheet feeding direction by the discharge roller pair 21 is an obliquely upward direction as indicated by an arrow Sf in FIG. 4, and such a synergistic effect of the effect of feeding a sheet in the obliquely upward direction and the effect of pressing a sheet by the right pressure flap group 28A and the left pressure flap group 28B forms a crest in the sheet. The crest is formed in an area between the right pressure flap group 28A and the left pressure flap group 28B. This area is a central area in the sheet width direction (X-axis direction).

In the above description, the structure of the sheet transport paths in the printer 1 has been described. Hereinafter, an arrangement relationship of components in the printer 1, specifically, an arrangement relationship among the components as viewed in the sheet width direction that intersects the sheet transport direction will be described mainly with reference to FIG. 5. In FIG. 5, a range H0 indicates an occupancy range of a path section (from position G4 to position G5) for reversing a sheet in the reverse-discharging path R3 in the vertical direction. A range H1 indicates an occupancy range of the sheet receiving section 32 in the vertical direction. A range H2 indicates an occupation range of the reversing roller 10 in the vertical direction. A range H3 indicates an occupation range of the feeding roller 61 in the vertical direction. A range H4 indicates an occupancy range of a main substrate 70 in the vertical direction. The main substrate 70 has various electronic components on the substrate and servers as a controller for performing various control operations to the printer 1. A range H5 indicates an occupancy range of a communication substrate 71 in the vertical direction. Although the communication substrate 71 is not a component in the printer 1 according to the embodiment and is a component of a printer 100 (FIG. 6) according to another embodiment described below, the communication substrate 71 is illustrated in FIG. 5 for the sake of convenience. A range H6 indicates an occupancy range of the carriage 14 including the recording head 15 in the vertical direction. A range H7 indicates an occupation range of a power supply unit 72 for supplying electric power in the vertical direction. A range H8 indicates an occupancy range of the ink tube 49 in the vertical direction. The ink tube 49 in the range H8 is a path section of the ink tube 49 that extends from the carriage 14 in the X direction, is folded, and extends in the X direction again.

When viewed in the sheet width direction, a path section (from position G1 to position G2) for reversing a sheet in the reverse-feeding path R1 and the path section (from position G4 to position G5) for reversing a sheet in the reverse-discharging path R3 have portions that overlap each other in the vertical direction. The portions that overlap each other in the vertical direction generally correspond to portions where the range H0 and the range H2 overlap each other. The path section (from position G1 to position G2) for reversing a sheet in the reverse-feeding path R1 and the path section (from position G4 to position G5) for reversing a sheet in the reverse-discharging path R3 are disposed above the recording head 15. With this structure having the reverse-feeding path R1 and the reverse-discharging path R3, the vertical dimension of the apparatus can be reduced and the increase in size of the apparatus can be prevented.

When viewed in the sheet width direction, the feeding roller 61 and the path section (from position G4 to position G5) for reversing a sheet in the reverse-discharging path R3 have portions that overlap each other in the vertical direction. The portions that overlap each other in the vertical direction correspond to portions where the range H0 and the range H3 overlap each other. With this structure having the feeding roller 61 (rear-feeding path R5) and the reverse-discharging path R3, the vertical dimension of the apparatus can be reduced and the increase in size of the apparatus can be prevented.

When viewed in the sheet width direction, the carriage 14 and the path section (from position G4 to position G5) for reversing a sheet in the reverse-discharging path R3 have portions that overlap each other in the vertical direction. The portions that overlap each other in the vertical direction correspond to portions where the range H0 and the range H6 overlap each other. With this structure having the carriage 14 and the reverse-discharging path R3, the vertical dimension of the apparatus can be reduced and the increase in size of the apparatus can be prevented.

When viewed in the sheet width direction, the sheet receiving section 32 and the path section (from position G4 to position G5) for reversing a sheet in the reverse-discharging path R3 have portions that overlap each other in the vertical direction. The portions that overlap each other in the vertical direction correspond to portions where the range H0 and the range H1 overlap each other. With this structure having the sheet receiving section 32 and the reverse-discharging path R3, the vertical dimension of the apparatus can be reduced and the increase in size of the apparatus can be prevented.

The reverse-feeding path R1 is disposed on the apparatus rear side and the reverse-discharging path R3 is disposed on the apparatus front side. With this structure, when viewed in the sheet width direction, the amount of overlap between the reverse-feeding path R1 and the reverse-discharging path R3 in the vertical direction can be readily ensured.

The lower end portion (G3) of the reversing roller 10, a range J0 within which recording onto a sheet is performed by the recording head 15, and a range (range around the position G4) in the reverse-discharging path R3 where upward bending of a sheet starts are aligned along the horizontal direction. With this structure, when viewed in the sheet width direction, the amount of overlap among the reverse-feeding path R1, the recording head 15, and the reverse-discharging path R3 in the vertical direction can be sufficiently ensured, and further reduction in size of the apparatus can be achieved.

From the apparatus rear side toward the apparatus front side, the reversing roller 10, the feeding roller 61, the carriage 14, and the reverse-discharging path R3 are disposed in this order, and when viewed in the sheet width direction, the reversing roller 10 (range H2), the feeding roller 61 (range H3), the carriage 14 (range H6), and the path section (from position G4 to position G5: range H0) for reversing a sheet in the reverse-discharging path R3 have portions that overlap each other in the vertical direction. With this structure, the vertical dimension of the apparatus can be reduced and the increase in size of the apparatus can be prevented.

The folded portion 49*b* of the ink tube 49 and the path section (from position G4 to position G5) for reversing a sheet in the reverse-discharging path R3 have portions that overlap each other in the vertical direction. The portions that overlap each other in the vertical direction correspond to portions where the range H0 and the range H8 overlap each other. With this structure having the folded portion 49*b* of the ink tube 49 and the reverse-discharging path R3, the vertical dimension of the apparatus can be reduced and the increase in size of the apparatus can be prevented. The ink tank 63 (FIG. 1, FIG. 2) occupies most of the area in the vertical direction in the apparatus body 2. Accordingly, an occupancy range of the ink tank 63 (FIG. 1, FIG. 2) in the height direction has a portion that overlaps with all the ranges H1 to H8 in the vertical direction.

The main substrate 70 and the path section (from position G4 to position G5) for reversing a sheet in the reverse-discharging path R3 have portions that overlap each other in the vertical direction. The portions that overlap each other in the vertical direction correspond to portions where the range H0 and the range H4 overlap each other. With this structure having the main substrate 70 and the reverse-discharging path R3, the vertical dimension of the apparatus can be reduced and the increase in size of the apparatus can be prevented. The main substrate 70 according to the embodiment is disposed on the left side (the side opposite to the side where the ink tank 63 illustrated in FIG. 1 and FIG. 2 is disposed) in the apparatus width direction (X direction).

The power supply unit 72 and the path section (from position G4 to position G5) for reversing a sheet in the reverse-discharging path R3 have portions that overlap each other in the vertical direction. The portions that overlap each other in the vertical direction correspond to portions where the range H0 and the range H7 overlap each other. With this structure having the power supply unit 72 and the reverse-discharging path R3, the vertical dimension of the apparatus can be reduced and the increase in size of the apparatus can be prevented. The power supply unit 72 according to the embodiment is disposed on the left side (the side opposite to the side where the ink tank 63 illustrated in FIG. 1 and FIG. 2 is disposed) in the apparatus width direction (X direction).

Figure 6:
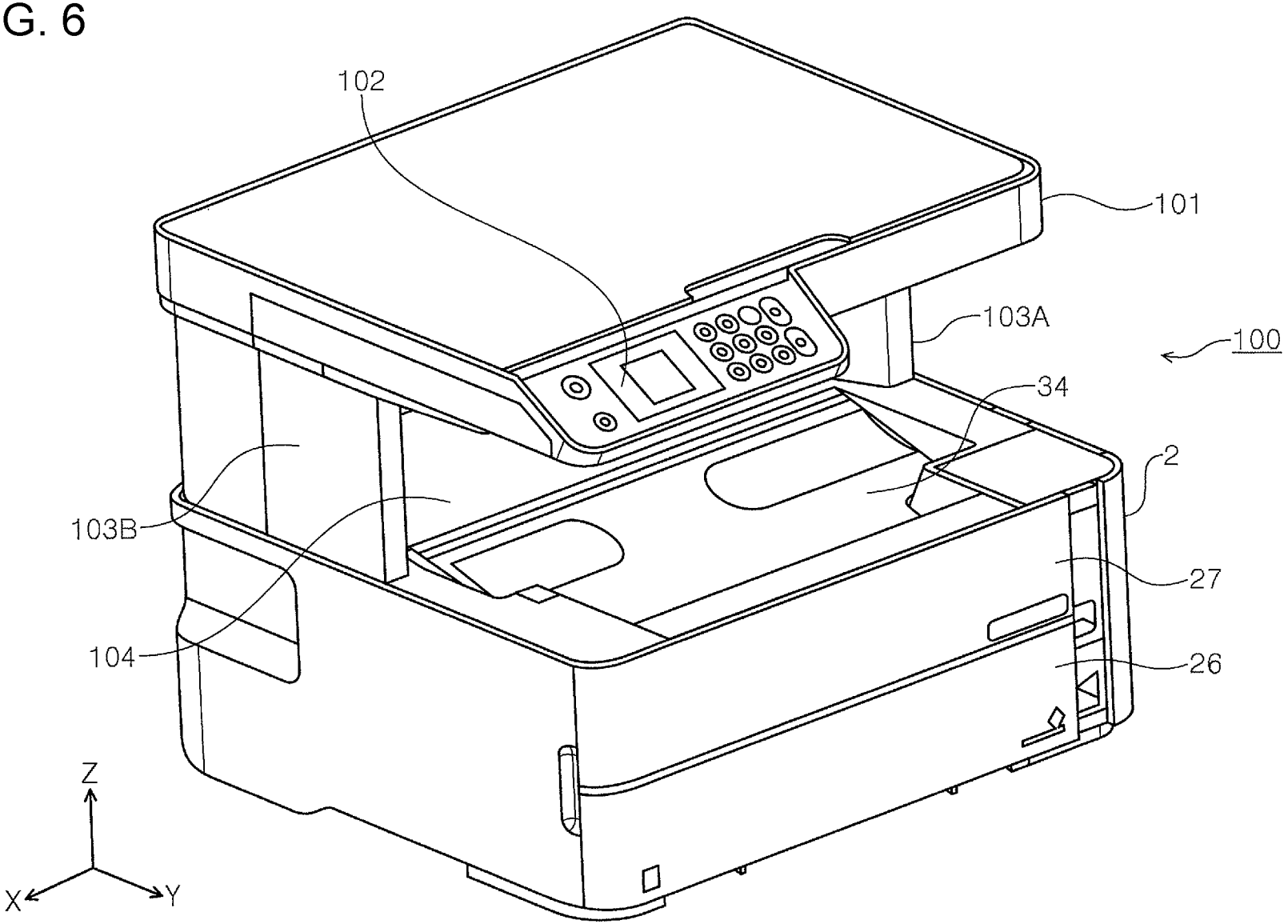
FIG. 6 is an external perspective view of a printer according to another embodiment.

The above-described printer 1 has only the recording function for performing recording onto a sheet. In addition to the recording function, the printer 1 may be provided with a function for reading a document, that is, the printer 1 may be a so-called multifunction peripheral having the reading function. The printer 100 illustrated in FIG. 6 is an example multifunction peripheral having the reading function. The printer 100 has a scanner unit 101 that serves as a reading apparatus for reading a document. The printer 100 includes support sections 103A and 103B on an upper section of the apparatus body 2. The scanner unit 101 is supported by the support sections 103A and 103B. The scanner unit 101 includes an operation section 102 on an apparatus front side. By using the operation section 102, the user can operate the scanner unit 101 and the apparatus body 2. The printer 100 is provided with a second discharge tray 104 instead of the above-described top panel member 3 of the apparatus body 2. The second discharge tray 104 has an inclined surface, for example, a surface that extends directly from the sheet receiving surface of the first discharge tray 34. The other structures of the apparatus body 2 are similar to those in the above-described first embodiment.

The printer 100 may be provided with an automatic document feeder in the scanner unit 101. The printer 100 may be provided with a facsimile communication function in the scanner unit 101. In such a case, a circuit board for implementing the facsimile communication function is to be provided, and the communication substrate 71 illustrated in FIG. 5 can be used as the circuit board. The communication substrate 71 and the path section (from position G4 to position G5) for reversing a sheet in the reverse-discharging path R3 in FIG. 5 have portions that overlap each other in the vertical direction. The portions that overlap each other in the vertical direction correspond to portions where the range H0 and the range H5 overlap each other. With this structure having the communication substrate 71 and the reverse-discharging path R3, the vertical dimension of the apparatus can be reduced and the increase in size of the apparatus can be prevented. The communication substrate 71 according to the embodiment is disposed on the left side (the side opposite to the side where the ink tank 63 illustrated in FIG. 1 and FIG. 2 is disposed) in the apparatus width direction (X direction).

It is to be understood that the present disclosure is not limited to the above-described embodiments, various modifications can be made within the scope of the following claims, and these modifications are included within the scope of the present disclosure.

What is claimed is:

1. A recording apparatus comprising:

a medium mounting section on which a medium is to be mounted;

a reverse-feeding path for reversing the medium that is fed from the medium mounting section;

a recording path at which a recording unit configured to record on the medium that is reversed by the reverse-feeding path is provided;

a reverse-discharging path for transporting the medium recorded by the recording unit from the recording path to a discharge section, reversing the medium and discharging the medium to the discharge section; and a discharge path for transporting the medium recorded by the recording unit from recording path and discharging the medium with the recorded surface placed face up, wherein when viewed in a medium width direction intersecting a medium transport direction, a path section for reversing the medium in the reverse-feeding path and a path section for reversing the medium in the reverse-discharging path have portions overlapping each other in the vertical direction.

2. The recording apparatus according to claim 1, further comprising, a switching member that is configured to switch a first state at which the medium is discharged via the reverse-discharging path and a second state at which the medium is discharged via the discharge path, wherein when viewed in the medium width direction, the path section for reversing the medium in the reverse-feeding path overlaps with the switching member in the vertical direction.

3. The recording apparatus according to claim 1, further comprising, a roller that is provided at the recording path, the roller configured to regulate a discharge direction in which the medium is discharged via the discharge path; and when viewed in the medium width direction, the path section for reversing the medium in the reverse-feeding path overlaps with the roller in the vertical direction.

4. The recording apparatus according to claim 2, further comprising, a roller that is provided at the recording path, the roller configured to regulate a discharge direction in which the medium is discharged via the discharge path; and when viewed in the medium width direction, the path section for reversing the medium in the reverse-feeding path overlaps with the roller in the vertical direction.

5. The recording apparatus according to claim 3, further comprising, a carriage provided with the recording unit, the carriage being configured to move along a medium width axis intersecting a medium transport direction;

a liquid container configured to store a liquid to be discharged from the recording unit;

a liquid tube configured to introduce the liquid from the liquid container to the recording unit; and a roller supporting member that supports the roller and the liquid tube, wherein when viewed in the medium width direction, the path section for reversing the medium in the reverse-feeding path overlaps with the roller supporting member in the vertical direction.

6. The recording apparatus according to claim 5, wherein the liquid tube extends along a reciprocation axis of the carriage and has a folded portion that is folded from one reciprocation direction to the other reciprocation direction, and when viewed in the medium width direction, the folded portion of the liquid tube and the reverse-discharging path have portions overlapping each other in the vertical direction.

7. The recording apparatus according to claim 4, further comprising, a carriage provided with the recording unit, the carriage being configured to move along a medium width axis intersecting a medium transport direction;

a liquid container configured to store a liquid to be discharged from the recording unit;

a liquid tube configured to introduce the liquid from the liquid container to the recording unit; and a roller supporting member that supports the roller and the liquid tube, wherein when viewed in the medium width direction, the path section for reversing the medium in the reverse-feeding path overlaps with the roller supporting member in the vertical direction.

8. The recording apparatus according to claim 7, wherein the liquid tube extends along a reciprocation axis of the carriage and has a folded portion that is folded from one reciprocation direction to the other reciprocation direction, and when viewed in the medium width direction, the folded portion of the liquid tube and the reverse-discharging path have portions overlapping each other in the vertical direction.

9. The recording apparatus according to claim 2, further comprising:

a circuit board provided with electronic components; and a power supply unit configured to supply electric power, wherein when viewed in the medium width direction, the circuit board and the path section for reversing the medium in the reverse-discharging path have portions overlapping each other in the vertical direction and when viewed in the medium width direction, the power supply unit and the path section for reversing the medium in the reverse-discharging path have portions overlapping each other in the vertical direction.

10. The recording apparatus according to claim 2, further comprising:

a circuit board provided with electronic components; and a liquid container configured to store a liquid to be discharged from the recording unit, wherein when viewed in the medium width direction, the circuit board and the path section for reversing the medium in the reverse-discharging path have portions overlapping each other in the vertical direction, and the circuit board is provided at a first side of the recording apparatus in the medium width direction, the first side being opposite to a second side at which the liquid container is provided.

11. The recording apparatus according to claim 2, wherein the medium transport direction at the recording path is a direction from an apparatus rear side to an apparatus front side, and the reverse-feeding path is provided at the apparatus rear side and the reverse-discharging path is provided at the apparatus front side.

12. The recording apparatus according to claim 3, wherein the medium transport direction at the recording path is a direction from an apparatus rear side to an apparatus front side, and the reverse-feeding path is provided at the apparatus rear side and the reverse-discharging path is provided at the apparatus front side.

13. The recording apparatus according to claim 2, further comprising:

a guiding path for guiding the medium that is transported in a direction opposite to the transport direction from a position facing the recording unit to the reverse-feeding path.

14. The recording apparatus according to claim 3, further comprising:

a guiding path for guiding the medium that is transported in a direction opposite to the transport direction in recording from a position facing the recording unit to the reverse-feeding path.

15. The recording apparatus according to claim 13, wherein the reverse-feeding path reverses the medium by an outer circumferential surface of a reversing roller.

16. The recording apparatus according to claim 14, wherein the reverse-feeding path reverses the medium by an outer circumferential surface of a reversing roller.

17. The recording apparatus according to claim 2, further comprising:

a power supply unit configured to supply electric power, wherein when viewed in the medium width direction, the power supply unit overlaps with the switching member in the vertical direction.

18. A recording apparatus comprising:

a medium mounting section on which a medium is to be mounted;

a reverse-feeding path for reversing the medium that is fed from the medium mounting section;

a recording path at which a recording unit configured to record on the medium that is reversed by the reverse-feeding path is provided; and a reverse-discharging path for transporting the medium recorded by the recording unit from the recording path to a discharge section, reversing the medium and discharging the medium to the discharge section; and a discharge path for transporting the medium recorded by the recording unit from recording path and discharging the medium with the recorded surface placed face up, wherein a path section for reversing the medium in the reverse-feeding path and a path section for reversing the medium in the reverse-discharging path are disposed above the recording unit, and when viewed in a medium width direction intersecting a medium transport direction, the reverse-feeding path and the recording path have portions overlapping each other in the vertical direction.

19. The recording apparatus according to claim 18, further comprising, a switching member that is configured to switch a first state at which the medium is discharged via the reverse-discharging path and a second state at which the medium is discharged via the discharge path, wherein when viewed in the medium width direction, reverse-feeding path overlaps with the switching member in the vertical direction.

20. The recording apparatus according to claim 19, further comprising, a roller that is provided at the recording path, the roller configured to regulate a discharge direction in which the medium discharged via the discharge path; and when viewed in the medium width direction, reverse-feeding path overlaps with the roller in the vertical direction.

* * * * *